US009365310B2

(12) United States Patent
Stevens et al.

(10) Patent No.: US 9,365,310 B2
(45) Date of Patent: Jun. 14, 2016

(54) LABEL SYSTEM AND METHOD FOR LABEL ALIGNMENT AND PLACEMENT

(75) Inventors: Timothy A. Stevens, Warwick, NY (US); Jeff Campbell, Loveland, OH (US); Alexander Gelbman, Florham Park, NJ (US); Neil A. Moore, Sparta, NJ (US); Steven Savitz, Teaneck, NJ (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 0 days.

(21) Appl. No.: 13/480,559

(22) Filed: May 25, 2012

(65) Prior Publication Data

US 2013/0105064 A1 May 2, 2013

Related U.S. Application Data

(63) Continuation of application No. 10/838,108, filed on May 3, 2004, now abandoned, which is a continuation-in-part of application No. 09/370,634, filed on Aug. 6, 1999, now Pat. No. 6,428,640.

(60) Provisional application No. 60/096,390, filed on Aug. 13, 1998.

(51) Int. Cl.

| | |
|---|---|
| ***B65C 3/02*** | (2006.01) |
| ***B65C 9/44*** | (2006.01) |
| ***B65C 9/46*** | (2006.01) |

(52) U.S. Cl.

CPC ... *B65C 3/02* (2013.01); *B65C 9/44* (2013.01); *B65C 9/46* (2013.01)

(58) Field of Classification Search

CPC ..... B65C 3/02; B65C 9/42; B65C 9/44; B65C 9/46; B65C 2009/40; B65C 2009/401; B65C 2009/402; B65C 2009/404; B65C 2009/405

USPC ..... 156/60, 64, 215, 277; 428/42.2, 42.3, 428/42.1, 40.1

See application file for complete search history.

(56) References Cited

U.S. PATENT DOCUMENTS 4,015,352 A * 4/1977 Prange ..... 40/594
4,344,994 A * 8/1982 Batty et al. ..... 428/42.2

(Continued)

FOREIGN PATENT DOCUMENTS

JP 62108206 U 7/1987
JP 0590536 U 12/1993
JP 9073493 A 3/1997

*Primary Examiner* — George Koch

(74) *Attorney, Agent, or Firm* — The Webb Law Firm

(57) ABSTRACT

The present invention is a label system and method for label alignment and placement on a container. The label system includes a first label or a container whereby the first label includes alignment symbology and a second label having an alignment area corresponding to the alignment symbology of the first label. The second label is positioned on the container whereby the alignment area of the second label is aligned with the alignment symbology of the first label. The method for label alignment and placement comprises the steps of (i) providing a container with identification information and a label bearing area; (ii) scanning the identification information; (iii) processing the identification information; (iv) printing indicia on a label at a position defined by the identification information; and (v) placing the label on the container with the indicia positioned at the desired predetermined location.

14 Claims, 6 Drawing Sheets

(56) References Cited

U.S. PATENT DOCUMENTS 5,164,575 A * 11/1992 Neeley et al. ..... 235/472.01
5,178,417 A 1/1993 Eshoo
5,401,110 A * 3/1995 Neeley ..... 400/621
6,428,640 B1 8/2002 Stevens et al.
6,613,410 B1 9/2003 Sellars

* cited by examiner

LABEL SYSTEM AND METHOD FOR LABEL ALIGNMENT AND PLACEMENT

This application is a continuation of U.S. patent application Ser. No. 10/838,108filed on May 3, 2004, now abandoned, which is a continuation-in-part of U.S. patent application Ser. No. 09/370,634, filed on Aug. 6, 1999, now U.S. Pat. No. 6,428,640, and Provisional U.S. Patent Application Ser. No. 60/096,390, filed on Aug. 3, 1998.

BACKGROUND OF THE INVENTION

1. Field of the Invention

The present invention relates to a label system and method for proper positioning of a label on a container and for ensuring proper alignment of printed information on a label for subsequent reading. More particularly, the present invention relates to proper positioning of bar code information on a label for attachment to a container to ensure positioning of the bar code at a predetermined position for subsequent reading or scanning by automated laboratory analysis equipment.

2. Description of Related Art

Proper placement of a printed label on a container is important for ensuring subsequent reading of the information printed on the label. If not properly placed, the printed information is not easily seen, or cannot easily be scanned, by automated equipment.

Proper placement of the bar code information on a specimen collection container is important to ensure proper scanning of the encoded information by various clinical equipment and analytical testing instrumentation. If the bar code information is not properly positioned on the sample container, the scanner of the instrumentation may not be able to read the bar code, thus requiring the operator to manually scan the bar code information, or manually enter the bar code information into the instrumentation.

Accordingly, a need exists for a system which is capable of properly aligning a label on a specimen collection container. Further, a need exists for a system capable of printing indicia on a label, such as bar code information, in a standard position with respect to the container for subsequent automated reading or scanning.

SUMMARY OF THE INVENTION

The present invention is a label system and method for proper alignment and placement of a label on a container.

Desirably, the label system comprises a first label and a second label. The first label is located on a container and includes alignment symbology. The alignment symbology may be in the form of a distinct shape, such as a triangle or a diamond or in the form of a protrusion.

The second label desirably includes an alignment area corresponding to the alignment symbology of the first label. The alignment area may be in the form of an opening or a transparent portion.

Preferably, the second label is positioned on the container such that the alignment area of the second label is aligned with the alignment symbology of the first label, whereby the alignment symbology is detectable through the alignment area of the second label to assure proper alignment of the second label on the container.

Alternatively, the first label may include alignment symbology in the form of a protrusion whereby the protrusion provides a means for detecting proper alignment both visually and through touch.

The present invention further includes a method for positionally locating indicia on a label for aligned placement of the indicia at a predetermined position on a container. Preferably, the indicia is in the form of a bar code that identifies the contents of the sample container.

Desirably, the method of the present invention for placing a label on a container comprises the following steps: (i) a container is provided having identification information associated with the container, which identifying information is unique to the container and which defines a fixed label bearing area on the container; (ii) printing a label with indicia being selectively located on the label at a position defined by the identifying information of the container; and (iii) placing the printed label on the label bearing area of the container so as to position the printed indicia at a predetermined location on the container.

Preferably, the method of the present invention for placing a label on a container with indicia at a predetermined location on the container, comprises the following steps:

(i) providing a specimen container with a label bearing area or desired predetermined location and identification information that defines the container;
(ii) reading or scanning the identification information on the specimen container confirming that the container scanned is of the type indicated to receive the specimen;
(iii) processing the identification information for positioning a label on the specimen container with respect to a desired predetermined location;
(iv) printing indicia on a label at a position defined by the identification information and the desired predetermined location; and
(v) placing the label on the container with the indicia positioned at the desired predetermined location.

Preferably, the method of the present invention for placing a label on a specimen container with indicia at a predetermined location on the container, comprises the following steps:

(i) providing a processing unit and means for scanning or reading information into the processing unit;
(ii) providing a patient identification bracelet with patient identification information;
(iii) providing a specimen container with a label bearing area or desired predetermined location and identification information that defines the container;
(iv) reading or scanning the patient identification information into the processing unit;
(v) processing the patient identification information in the processing unit; and
(vi) reading or scanning the identification information on the specimen container into the processing unit;
(vii) processing the identification information for positioning a label on the specimen container with respect to a desired predetermined location; and
(viii) printing indicia from the processing unit on a label at a position defined by said identification information from said container; and
(ix) placing the label on the container with the indicia positioned at the desired predetermined location.

The information identifying the container type may be in the form of printing appearing on the container at the fixed label bearing area, or may be in the form of a first label affixed to the container, with the first label including a marking to define the fixed label bearing area for proper placement of a printed, second label. Such marking is preferably an alignment symbology as described above.

The present invention therefore accomplishes the correct identification of the required tube for a specific test for a specific patient and generates the proper identification label with printed indicia positioned properly on the identification label for proper reading or scanning by the diagnostic analyzer and ensured proper alignment of the identification label onto the specimen container.

An important attribute of the present invention is that proper placement of identification indicia, for example, the bar code, ensures proper reading and scanning of the information by the scanners of the various instrumentation. In addition, the present invention provides, standardized positioning of identification indicia such as a bar code to insure efficiency and quality in analysis.

A further attribute of the present invention, is that an identification indicia is placed on a container, regardless of the size and shape of the container, so that the scanner of the instrumentation may be able to read the bar code and eliminate manually scanning the bar code information, or manually enter the bar code information into the instrumentation.

Most notably, is that the method of the present invention provides indicia on a label for a specimen container wherein the information about the specimen container and the patient are located as the indicia in one place on the container for proper identification of the container, the test to be conducted and the patient.

DETAILED DESCRIPTION

Figure 1:
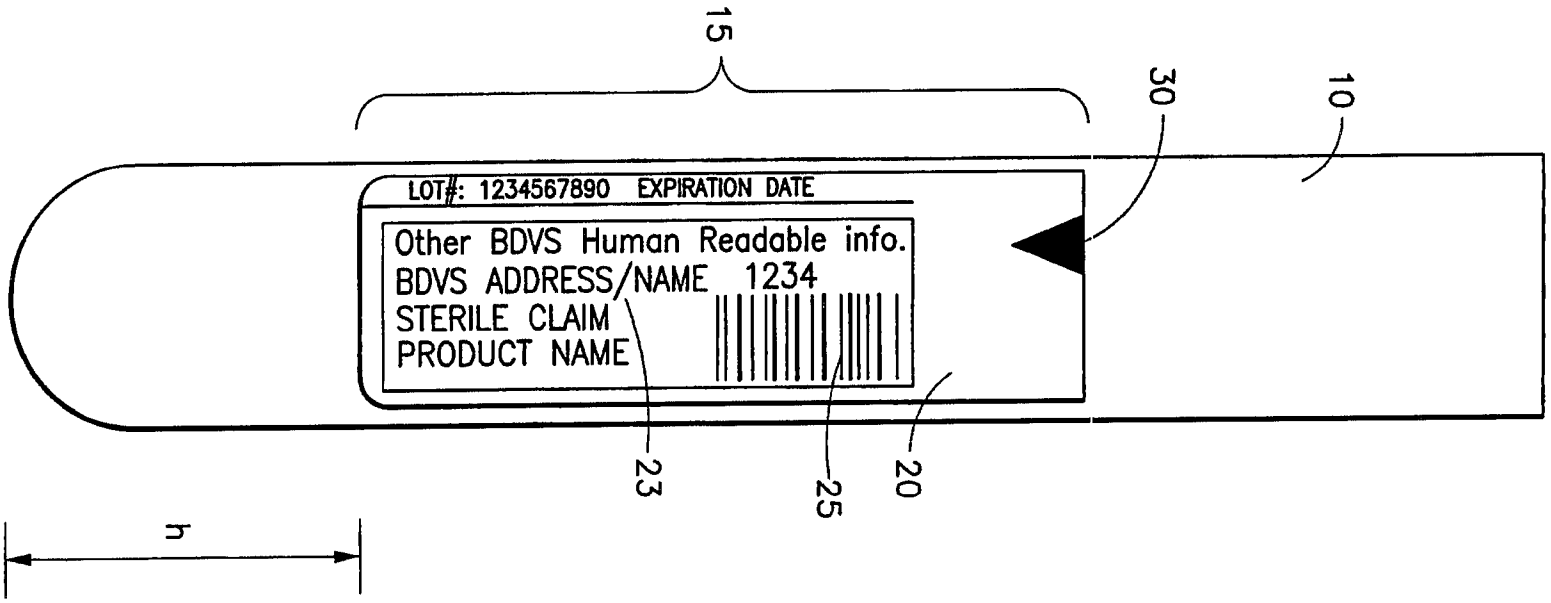
FIG. 1 illustrates a specimen container including a first label having alignment symbology and container identification symbology.

Referring to the drawings in which like reference characters refer to like parts throughout the several views thereof, FIG. 1 illustrates a container 10 with an alignment symbology 30 on an outer surface of container 10. Alignment symbology 30 is designed to aid in the alignment of an identification label subsequently placed over the container. The alignment symbology may be any type of symbol capable of assisting in the proper positioning and alignment of a subsequently placed label. For example, the alignment symbology may be a distinct shape in the form of a graphic or pictorial representation, such as a triangle, rectangle, diamond, circle, or the like, and mixtures thereof. Alternatively, the alignment symbology may be a protrusion which can be felt with the finger.

As shown in FIG. 1, container 10 includes a first label 20 affixed to the outer surface of the container or label bearing area 15, with alignment symbology 30 printed on label 20. Label 20 may further contain additional encoded or printed information thereon such as container identification symbology. Such identification symbology includes a bar code 25 and/or an alphanumeric indicia 23, either or both of which may include information identifying the specific type of the container, the manufacturer lot number, the expiration date, the size and/or shape of the container and the reagents and/or additives included within the container.

Figure 2:
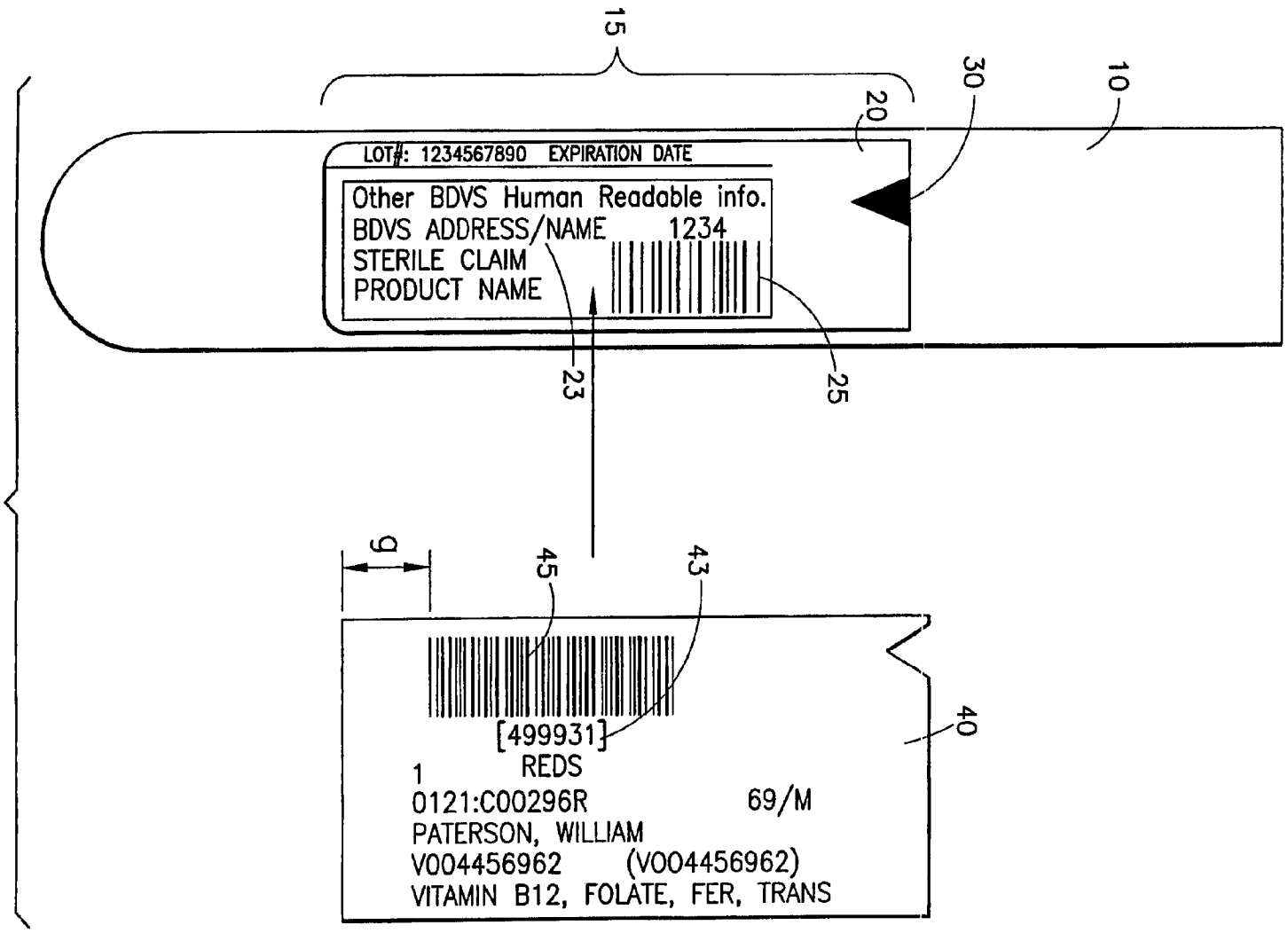
FIG. 2 illustrates a second label including an opening corresponding to the alignment symbology of first label of the specimen container of FIG. 1.

As shown in FIG. 2, an identification label 40 is provided for placement on container 10. Identification label 40 may include encoded or printed information thereon, such as a bar code 45 and/or an alphanumeric indicia 43, either or both or which may represent an identification of the sample contained within the container, information identifying the patient, what analyses are to be conducted on the sample and sampling information such as date and time of sampling. Identification label 40 may be generated by a printer located at nursing station or in a centralized laboratory or printed at the bedside with a portable printer.

Figure 4D:
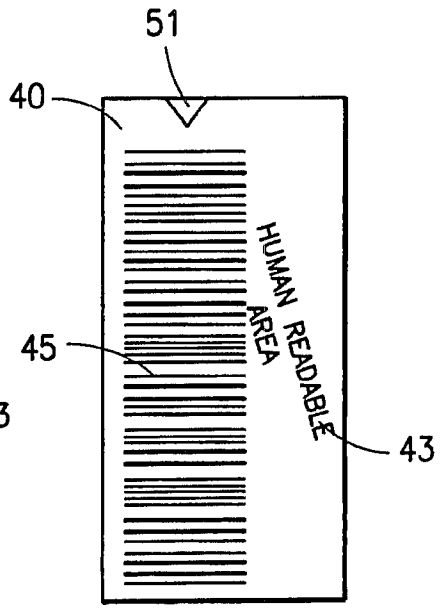
FIGS. 4*a*, 4*b*, 4*c* and 4*d* illustrate alternative embodiments of the label of the present invention whereby both first container label and second label must align to ensure proper placement.

Identification label 40 is provided as a second label capable of being affixed over label 20. Identification label 40 includes an alignment area 50 corresponding to alignment symbology 30 of label 20. Alignment area 50 may be an opening or notched cut-away of label 40. For example, as shown in FIG. 2, alignment symbology 30 is in the form of a v-shaped triangle and alignment area 50 is a v-shaped notch appearing on the edge of label 40. Alternatively, alignment area 50 may be a transparent portion having a shape designed to fit over alignment symbology 30, such as transparent portion 51 as shown in FIG. 4*d*.

Figure 3:
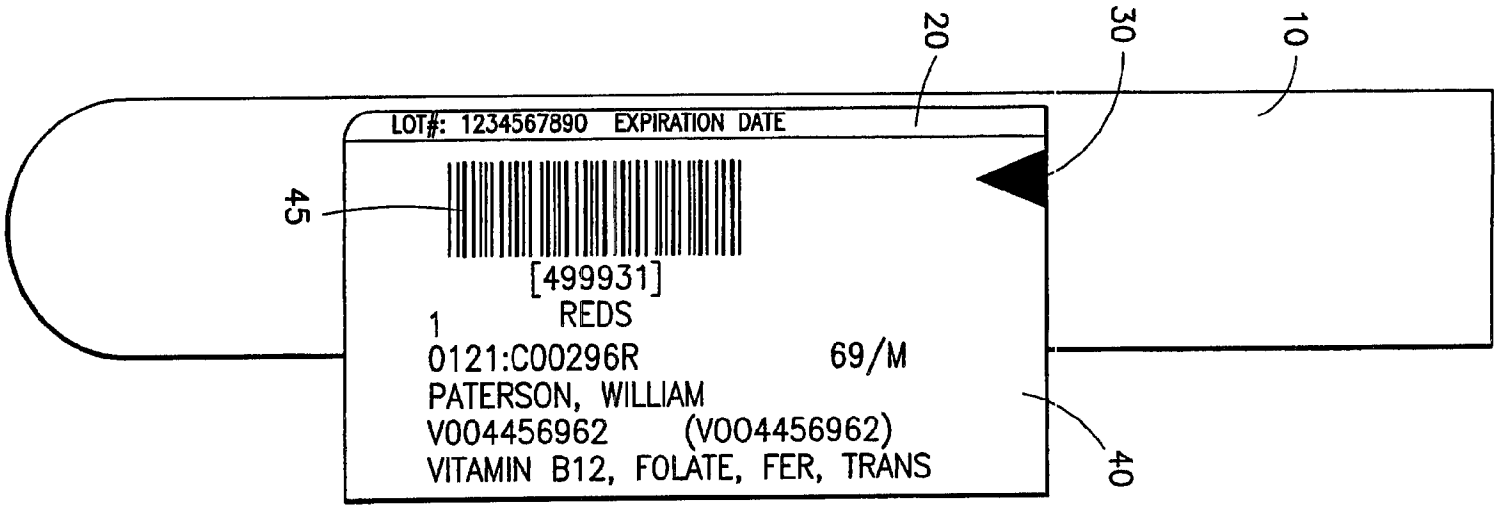
FIG. 3 illustrates a specimen container as in FIGS. 1 and 2 including the second label of FIG. 2 properly aligned on the container.

As shown in FIG. 3, identification label 40 is positioned on container 10 such that alignment area 50 of identification label 40 is aligned with alignment symbology 30 of label 20, with alignment symbology 30 being detectable through alignment area 50, thereby assuring proper alignment of the identification label on container 10.

It is within the purview of the present invention that alignment symbology 30 and identification label 40 are contrasting colors, for example, alignment symbology 30 is printed in black ink as a geometric shape, and identification label 40 is a white label including alignment area 50 therethrough. Therefore, the sharp contrast between the colors of the alignment symbology 30 and alignment area 50 provides accurate assurance that identification label 40 is properly aligned over container 10.

It is also within the purview of the present invention that alignment symbology 30 includes a protrusion, such as a v-shaped bump and alignment area 50 of identification label 40 is in the form of a v-shaped notch extending through identification label 40. Therefore, the v-shaped notch is aligned with the v-shaped bump of container 10 or container label 20 when identification label 40 is positioned over container label 20, with the v-shape ensuring both vertical and horizontal alignment of identification label 40 on container label 20. Moreover, such a protrusion provides a means for detecting proper alignment both visually and through touch to assure proper placement of identification label 40 over container label 20.

Figure 4C:
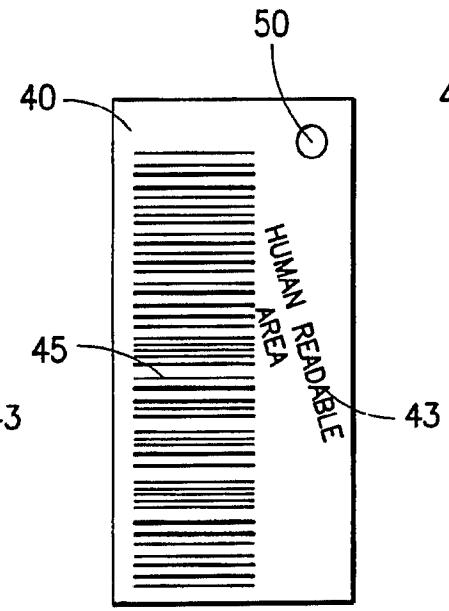
Figure 4B:
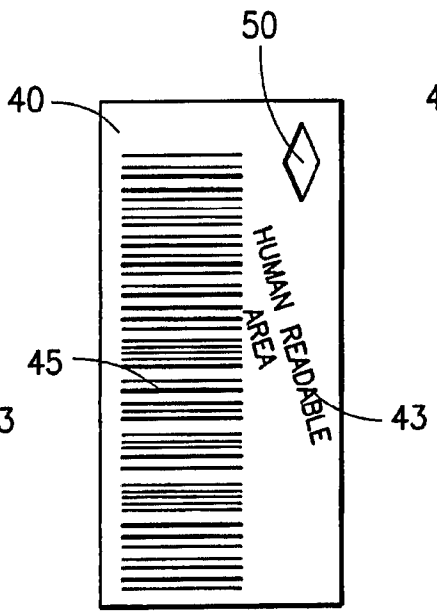
Figure 4A:
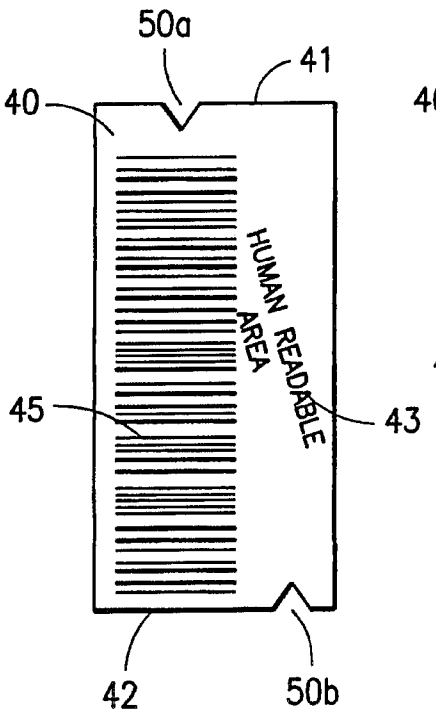

As shown in FIG. 4*a*, container label 20 may include a plurality of alignment. Areas 50*a* and 50*b* at opposed label edges 41 and 42. Alignment areas 50*a* and 50*b* are designed to cooperate with two separate alignment symbologies appearing on container 10 and/or container label 20.

It is within the purview of the present invention that alignment symbology 30 can be any shape or form, so long as alignment area 50 of identification label 40 properly corresponds to the shape and/or form of alignment symbology 30.

As shown in FIGS. 4*b*, 4*c*, and 4*d*, alignment area 50 can be in the shape of a diamond, or a circle which shapes would correspond to a similar shape alignment symbology appearing on container label 20. For ease of use, alignment symbology 30 and alignment area 50 corresponding to shapes which are non-rotationally symmetrical, such as a polygon, to assure proper alignment in both a vertical and horizontal direction and prevent identification label 40 from being improperly skewed or canted.

Figure 5:
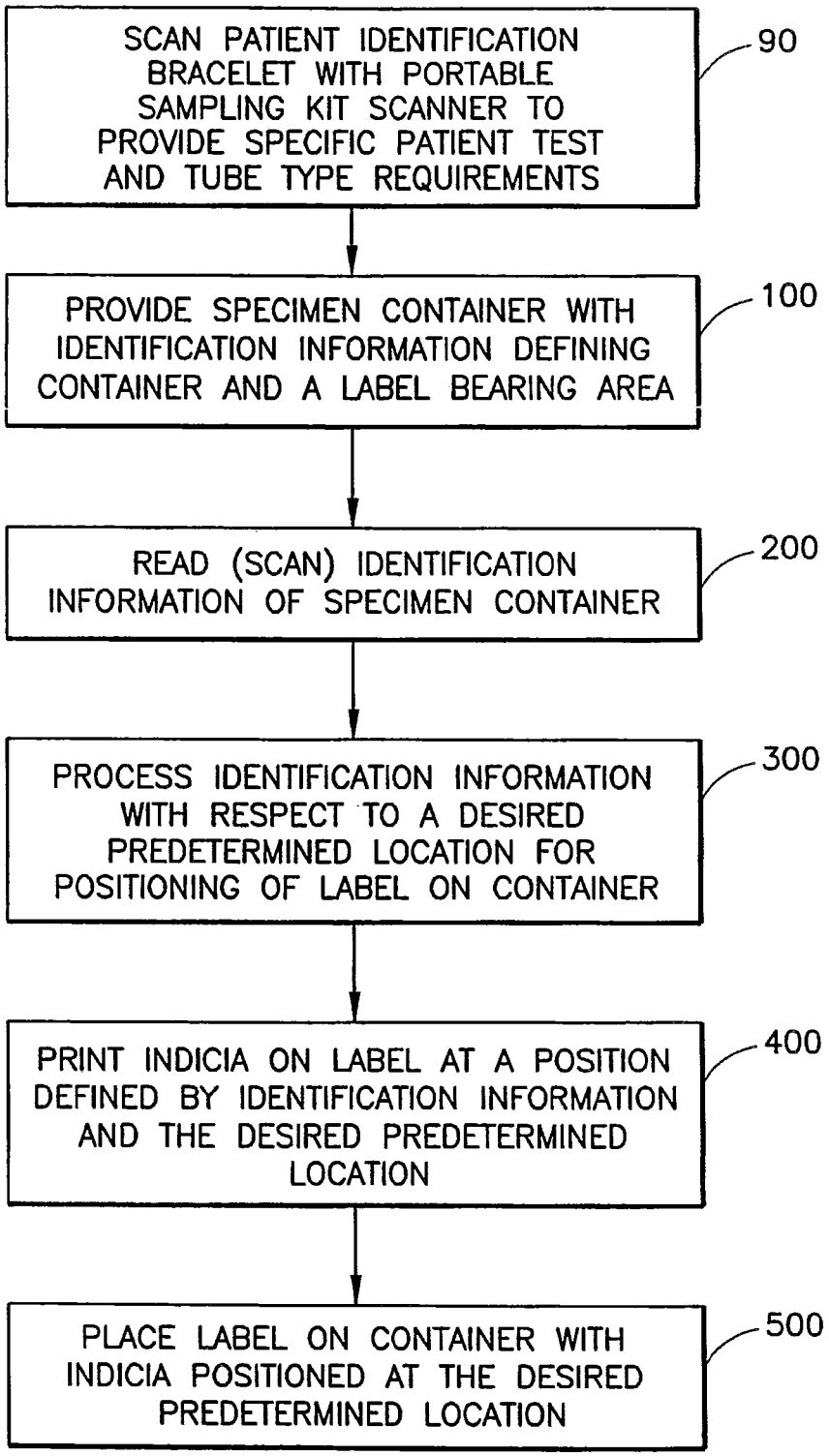
FIG. 5 illustrates a flow chart according to the method for second label generation (printing) and aligned placement of the second label.

The system and method for positionally locating indicia on a label for aligned placement of the indicia at a predetermined position on a container is illustrated in FIG. 5.

The system and method in use begins with an operator such as a phlebotomist is provided with a portable sampling kit including a scanner, a microprocessor/display screen and a printer including a supply of labels for printing thereon. As depicted in box 90 of FIG. 5, the patient identification bracelet is scanned with the portable sampling kit scanner to provide specific patient test and associated specific tube type requirements. The phlebotomist then selects the appropriate container 10 for containing the sample requirement. As shown in step 100 in the box diagram of FIG. 3, container 10 in the form of a blood collection tube is provided including bar code 25 including encoded information which identifies the container type and defines the location of label bearing area 15 unique to that container type. The phlebotomist is provided with a listing of patients requiring sampling. Each patient is provided with a patient identification bracelet, preferably including a bar code identification, as is well known in the art. As shown in step 200 of FIG. 5, the phlebotomist then scans bar code 25 on container 10 with the scanner. The portable sampling kit may provide the phlebotomist with confirmation that container 10 is appropriate for containing the sample requiring testing. It is also possible that the phlebotomist does not scan the container until after the collection and prior to requesting the printed label.

Bar code 25 includes encoded information which identifies the container type and defines the location of label bearing area 15 unique to that container type. For example, as depicted in FIG. 1*a*, container label is positioned at label bearing area 15 of container 10 at a predetermined distance h from the bottom of container 10. This predetermined distance h is determined according to the container type including the size and shape of container 10. The microprocessor of the sampling kit processes the encoded information of bar code 25 identifying the container type with respect to the location of label bearing area 15.

Figure 6:
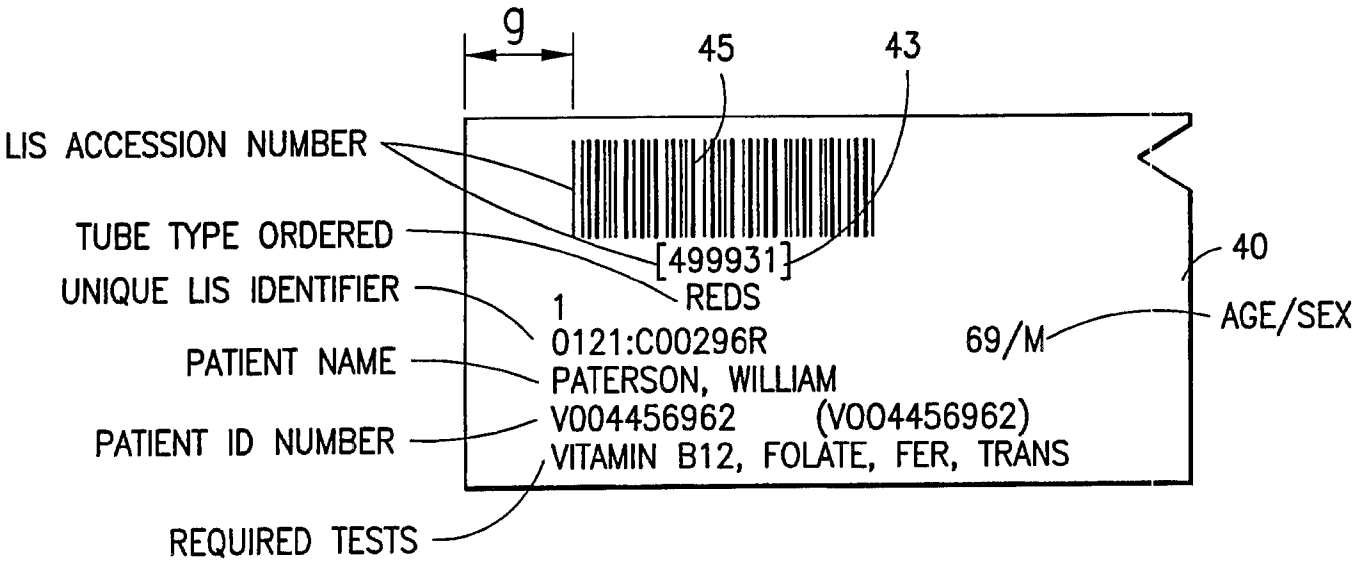
FIG. 6 illustrates the second label of the present invention.

The microprocessor further identifies what information is required for printing on identification label 40 to be affixed to container 10. Identification label 40 is provided with information identifying the patient, the type of sample, and what analyses are to be conducted on the sample, as well as sampling information such as date and time of sampling. As shown in FIG. 6, such information may be encoded as bar code 45, or may be in alphanumeric form, such as alphanumeric indicia 43 or may be provided in both bar code 45 and alphanumeric indicia 43.

After identifying the correctness of the container type and the information to be provided on the label, the microprocessor processes this information to determine the exact location for printing on identification label 40. For example, the microprocessor may be preprogrammed to ensure printing of bar code information at a specific predetermined position on a container, regardless of the size and shape of the container, so as to provide a standard position for such bar code information for all containers to effectuate subsequent reading, for example, by an automated analytical instrument including a bar code scanner. Thus, the microprocessor processes the information previously scanned from container label 20 with respect to the size of identification label 40. The microprocessor then determines the exact location for printing of the identification information on identification label 40 with respect to the predetermined standard position. In all cases, the alignment of the second label 40 onto the container is accomplished by the cut out on the label that is placed onto a matching symbol on the container.

For example, with reference to FIG. 1, the microprocessor processes the scanned information to determine that label bearing area 15 of container 10 is positioned distance h from the bottom of container 10. Further, the microprocessor recognizes from its memory that it is necessary to print bar code 45 on identification label 40 at a predetermined position with respect to label bearing area 15 and container 10, according to a standard position for the specific instrument to conduct the testing. The microprocessor then determines the exact position for printing bar code 45 on identification label 40 according to the desired predetermined position of bar code 45 with respect to label bearing area 15, for example, distance g from a bottom edge of identification label 40. Once the correct tube is identified, the microprocessor then instructs the printer to print the identification information in the form of bar code 45 on identification label 40 at a position, for example distance g, defined by the predetermined desired location of bar code 45 with respect to the container information scanned from container label 20, as depicted in step 400 of FIG. 5.

After bar code 45 is printed on identification label 40, the phlebotomist removes identification label 40 from the printer and affixes it to container 10 at label bearing area 15, according to step 500 of FIG. 5. Container 10 is provided with alignment symbology 30 and identification label 40 is provided with opening 50 corresponding to alignment symbology 30. In this manner, proper alignment and positioning of bar code 45 at a predetermined position with respect to the standard scanning position and the size and shape of container 10 is assured.

What is claimed is:

1. A method of positionally locating indicia on a label for aligned placement of said indicia at a predetermined location on a container comprising:

providing a container having identifying information associated with and unique to said container, which identifying information defines a fixed label bearing area on said container;

determining a location for printing the indicia on said label by:

processing the identifying information that defines the fixed label bearing area to determine a first distance from a bottom of the container at which the fixed label bearing area is located, wherein the first distance is determined according to a type of the container including a size and a shape of the container;

determining a specific type of instrument conducting a subsequent test after placement of the label of a plurality of different types of instruments; and determining a second distance from a bottom edge of the label for printing the indicia on the label based on the specific type of instrument conducting the subsequent test and with respect to the first distance that is determined according to a type of the container including a size and a shape of the container;

printing said indicia on said label at said determined location; and placing said label on said fixed label bearing area so as to position said indicia at said predetermined location on said container.

2. The method of claim 1, further including reading said identifying information prior to said printing of said indicia.

3. The method of claim 2, wherein said reading includes scanning said identifying information with a scanner.

4. The method of claim 2, further including the step of processing said read identifying information, prior to said printing of said indicia.

5. A label system for ensuring proper positioning of bar code information on a label, comprising:

a first label comprising alignment symbology and printing position information; and a second label comprising an alignment area corresponding to said alignment symbology of said first label;

wherein said second label is positioned to at least partially overlap said first label using the alignment symbology of the first label; and wherein the bar code information is printed on a location of said second label at a distance from the bottom of the second label that is determined, at least in part, on a specific type of instrument conducting a subsequent test after placement of the first and second labels determined from a plurality of different types of instruments with respect to the printing position information that includes a height of the first label from a bottom of a container, wherein the height is determined according to a type of the container including a size and shape of the container, and wherein said bar code information is aligned on said second label at a location determined by said alignment symbology.

6. The label system of claim 5, wherein said alignment area is an opening in said second label.

7. The label system of claim 5, wherein said alignment symbology is a protrusion on said first label.

8. The label system of claim 5, wherein said alignment area is a transparent portion of said second label.

9. A method for label alignment and placement, comprising the steps of:

(i) providing a container with identification information and a label bearing area;

(ii) scanning said identification information with a scanner into a processing unit;

(iii) processing said identification information in said processing unit to determine a location for printing indicia on a label based on a height of the label from a bottom of the container and a specific type of instrument conducting a subsequent test after placement of the label determined from a plurality of different types of instruments, the specific type of instrument conducting the test defining a distance from a bottom edge of the label for printing the indicia on the label with respect to the height, wherein the height is determined according to a type of the container including a size and a shape of the container;

(iv) printing indicia on the label at the location determined by said identification information and said specific type of instrument conducting test, wherein said indicia is aligned on said label and determined by the label bearing area; and (v) placing said label with said indicia on said container with said indicia positioned at said label bearing area.

10. The method of claim 9 wherein said identification information includes type of container and location of said label bearing area on said container.

11. The method of claim 10 wherein said identification information further includes patient identification information.

12. The method of claim 11 wherein said indicia includes identification of a patient, sample type, tests to be conducted, time, and date.

13. The method of claim 12 wherein said indicia is a bar code or alphanumeric.

14. A method of positionally locating indicia on a label for aligned placement of said indicia at a predetermined location on a container comprising:

providing a plurality of different containers having a plurality of different sizes and shapes, each container having identifying information associated with and unique to said container, which identifying information defines a fixed label bearing area on said container;

for each of said plurality of different containers, determining a location for printing the indicia on said label by:

processing the identifying information that defines the fixed label bearing area to determine a first distance from a bottom of the container at which the fixed label pg,21 bearing area is located, wherein the first distance is determined according to a type of the container including a size and a shape of the container;

determining a specific type of instrument conducting a subsequent test after placement of the label of a plurality of different types of instruments; and determining a second distance from a bottom edge of the label for printing the indicia on the label based on the specific type of instrument conducting the subsequent test and with respect to the first distance that is determined according to a type of the container including a size and a shape of the container;

printing said indicia on said label at said determined location; and placing said label on said fixed label bearing area so as to position said indicia at said predetermined location on said container, wherein a location of said indicia with respect to the specific type of instrument conducting the test is the same for each container of the plurality of different containers having the plurality of different sizes and shapes, and wherein the plurality of different types of instruments define a plurality of different second distances from the bottom edge of the label for printing the indicia on the label with respect to the first distance that is determined according to the type of the container including the size and the shape of the container.

* * * * *